US005675922A

United States Patent [19]

Skistimas

[11] Patent Number: 5,675,922

[45] Date of Patent: Oct. 14, 1997

[54] METHOD AND APPARATUS FOR BALLOON DISPLAYS

[76] Inventor: James Skistimas, 102 Tuesday Haus La., Highland Village, Tex. 75067

[21] Appl. No.: 190,444

[22] Filed: Feb. 1, 1994

[51] Int. Cl.[6] ..... G09F 7/00; G09F 21/06

[52] U.S. Cl. ..... 40/584; 40/214; 434/81; 211/89

[58] Field of Search ..... 446/221; 273/380, 273/458; 403/394, 397, 388, 400; 434/81, 98; 211/14, 89, 182; 40/212, 214, 217, 584, 541, 421

[56] References Cited

U.S. PATENT DOCUMENTS

| | | | |
|---|---|---|---|
| 935,905 | 10/1909 | Gilliland | 403/394 |
| 1,642,022 | 9/1927 | Groh | 40/212 |
| 1,658,275 | 2/1928 | Wright | 40/214 |
| 1,781,458 | 11/1930 | Gore | 403/388 |
| 1,813,901 | 7/1931 | Bayne | 434/81 X |
| 2,247,635 | 7/1941 | Illers | 273/380 |
| 3,046,040 | 7/1962 | Luper | 403/388 |
| 3,358,398 | 12/1967 | Chalfin . | |
| 3,448,538 | 6/1969 | Maze | 40/541 |
| 3,685,825 | 8/1972 | Dorazio | 273/458 |
| 4,155,552 | 5/1979 | Jacobo et al. | 273/380 X |
| 4,226,902 | 10/1980 | Webb . | |
| 4,850,926 | 7/1989 | Lovik | 446/222 |
| 4,927,400 | 5/1990 | Lovik | 446/220 |
| 4,941,856 | 7/1990 | Lovik | 446/220 |
| 5,141,463 | 8/1992 | Rouse, Jr. | 446/221 |

OTHER PUBLICATIONS

Dec. 20, 1994 Letter from Graham Rouse and Mary Queen to Pioneer Balloon Company.

Aug. 1987 "Balloons Today" Article re Spooney Morril.

Feb. 1988 "Balloons Today" Article –p. 57.

Rouse Balloon Art Designer Panels Description.

Oct. 1988 Article of "Balloons Today" Showing Palm Leaf Rouse Balloon Art Designer Panels.

Pages 22–23 of Gary Wells' Book "Design".

Pages 16–18 of Mar./Apr. 1992 Issue of "Images".

Cover Page and p. 4 of Jan./Feb. 1993 Issue of "Images"; Cover—p. 36 of Jan. 1993 Issue of Balloon World; p. 20 of Special Events Flyer; Page from Jul./Aug. 1993 Edition of Images.

Pages of 8–9 of Sep./Oct. 1992 Issue of "Images" re Linear Look Achieved With 260Qs and Foam board.

Page 32 of Mar./Apr. 1993 "Images" re Nifty Lacing Technique.

Page 12 of May/Jun. 1993 "Images" re Use of Cutouts in Foam board.

Page 4 of Jan./Feb. 1994 "Images" and p. 15 of May/Jun./Jul. 1994 Images re Flexible Sheet with Balloons Maintained by Pneumatic Pressure.

*Primary Examiner*—Joanne Silbermann
*Attorney, Agent, or Firm*—Stinson, Mag & Fizzell

[57] ABSTRACT

A grid structure having openings of various shapes are utilized in a display using balloons. Balloons are inserted in openings in the grid structure and inflated. The pneumatic pressure of the inflated balloon holds the balloon in the grid opening. The balloons may arrayed to produce designs of animate and inanimate objects. The displays may be in a single two dimensional plane, or the grid structure may be bent and twisted in a desired shape to provide a three dimensional display.

5 Claims, 6 Drawing Sheets

METHOD AND APPARATUS FOR BALLOON DISPLAYS

FIELD OF THE INVENTION

This invention relates to decorative designs utilizing balloons, and more particularly to an apparatus and method for making displays utilizing a grid and balloons for artistic displays.

BACKGROUND OF THE INVENTION

In using balloons for decorative purposes, a plurality of balloons are tied together for forming animated objects and other decorative motifs. In U.S. Pat. Nos. 4,850,926, 4,927,400, 4,941,856, rigid rod-like forms are used to stretch inflated balloons to deform them and connect several balloons together to multiple balloon displays. Each balloon in the display is inflated.

U.S. Pat. No. 5,141,463, utilizes a rigid rod in the balloon or membrane and the membrane is then inflated. In this patent, a deforming device is inserted into the balloon prior to inflating the balloon.

U.S. Pat. No. 4,226,902 utilizes a flat back on which a gas-tight envelope is mounted and inflated.

Other prior art methods include inserting balloons within balloons and inflating the inner as well as the outer balloon. In each case cited above the outer envelope of the decorative objected has to be air-tight to allow inflation of the outer envelope.

SUMMARY OF THE INVENTION

The present invention is to an apparatus and method for mounting balloons to make artistic displays. A frame with an array of openings has balloons inserted in the openings and held in place by the pneumatic pressure of the sides of the inflated balloons. One or more balloons may be inserted in each opening, each balloon being of the same or different color to form a distinct design.

The frame may be a metal, plastic, wood, or other suitable material. In one embodiment, the grid of the frame may be made up of light transmitting plastic to provide illumination. The openings may be of any geometrical shape.

Once the balloons are mounted in the grid, lights may be positioned behind selected balloons to illuminate the outlines of various designs. Also, selected balloon may have a small explosive charge attached to burst selected balloons to provide a design of balloons and openings.

The technical advance represented by the invention, as well as the objects thereof, will become apparent from the following description of a preferred embodiment of the invention when considered in conjunction with the accompanying drawings, and the novel features set forth in the appended claims.

DESCRIPTION OF A PREFERRED EMBODIMENT

Figure 1:
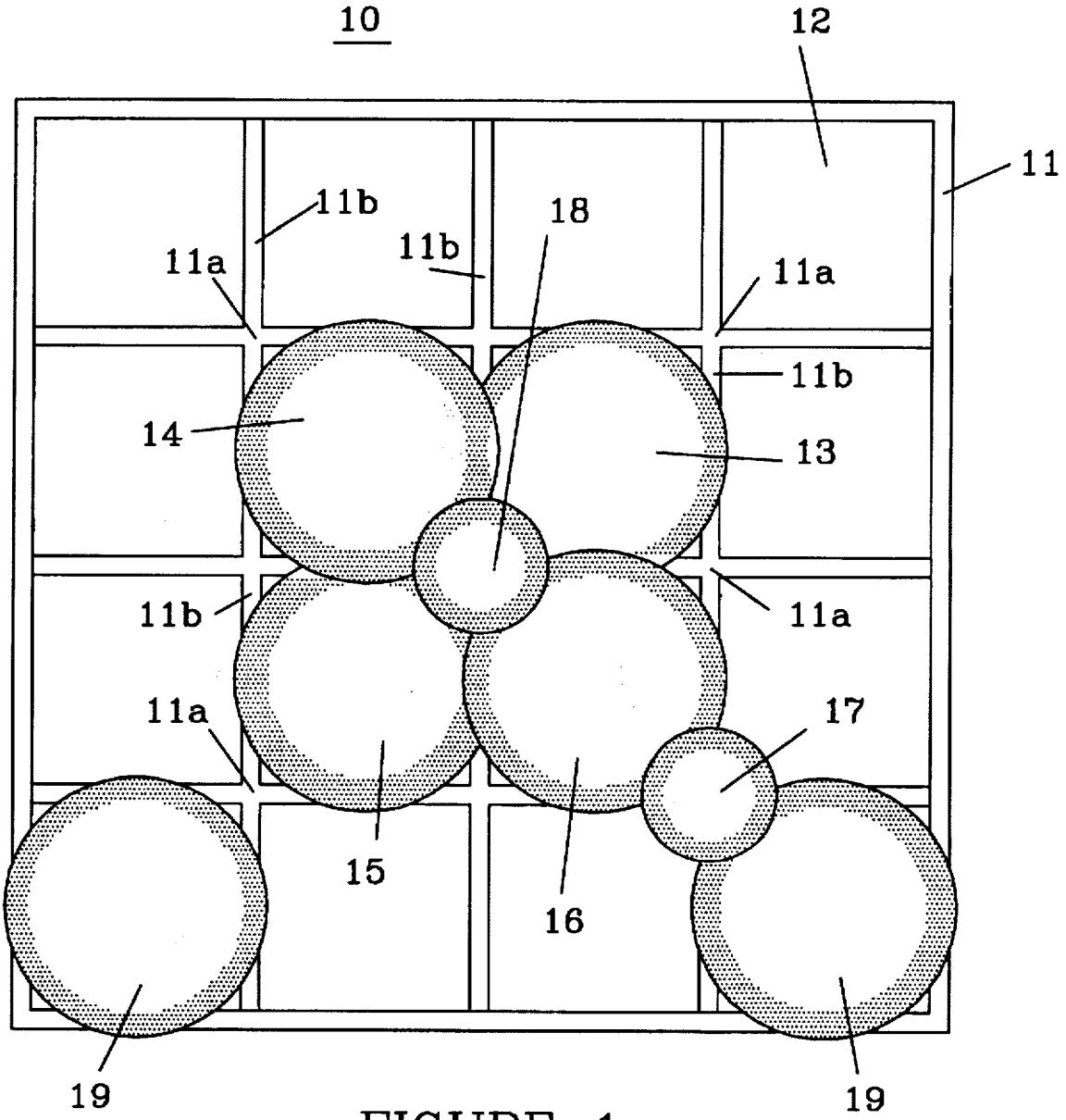
FIG. 1 shows a grid structure with several balloons mounted therein.

FIG. 1 illustrates a basic illustration of the present invention. A display 10 includes a frame 11 including a plurality of grid openings 12. Balloons 14–20 are inserted through the grid 12 openings and inflated to wedge the sides of the inflated balloon, against grid sides 11*b*, within the grid opening 12. The balloons are held in place by the pneumatic pressure of the air within the balloons. As illustrated in FIG. 1, balloons 13, 14, 15 and 16 are inserted into adjacent gird openings 12. Another balloon 18 is inserted through one of the grid openings, placing balloon 18 at a central location to balloons 13–16. Balloon 18 may he held in place by the pneumatic pressure of the air in the balloon, or may be tied at an intersection 11*a* of the grid at the junction of the four adjacent grid openings through which balloons 13–16 are inserted.

The grid structure may utilize grid openings of the same size, or grid openings of different sizes. The openings may be square, rectangular, round, or any desired geometric shape. The grid structure may be made of any rigid material, and also may be of a flexible material so as to distort and bend the grid structure in a desired shape.

Additional balloons 19 are shown mounted in grid openings 12. Balloon 17 is mounted between balloons 16 and 20 at the intersection of the grids in which balloons 16 and 20 are mounted.

A plurality of balloons may be mounted in the grid frame 11 in various grid openings 12 to produce a desired design and outline animated and inanimate objects. The balloons may be of various colors to produce the design.

Figure 2:
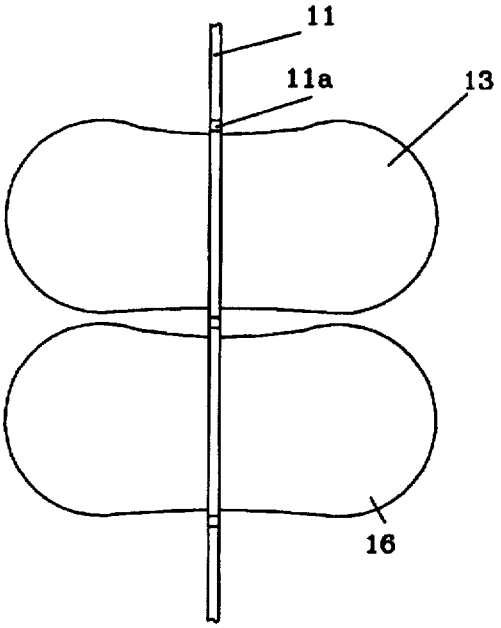
FIG. 2 is a side view of a grid structure with two balloon mounted in grid openings.

FIG. 2 is a side view of grid frame 11 showing, for example, balloons 13 and 16 of FIG. 1 extending through the grid openings of grid frame 11, and held in place by the inflation of the balloon. Since the balloon will distort to accommodate to the size of the grid opening it will be generally larger on each side of the grid frame and will inflated to expand and touch adjacent balloons, concealing the grid frame.

Figure 3:
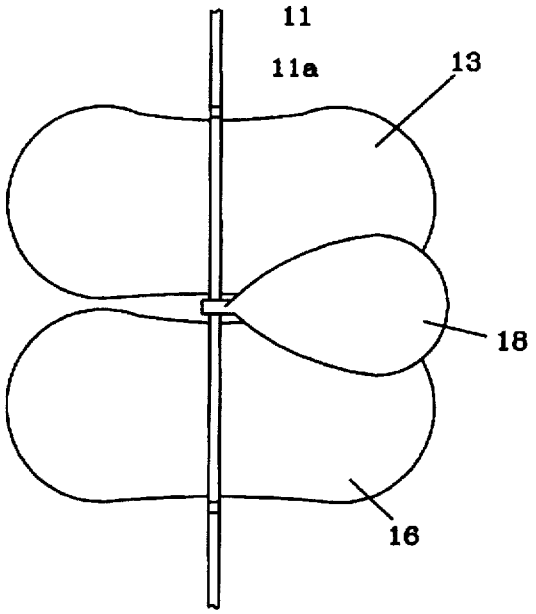
FIG. 3 is a side view of a grid structure with two balloons mounted through grids and a third balloon between the first two balloons.

FIG. 3 shows the side view of FIG. 2, with the addition of balloon 18 inserted between balloons 13 and 16. The end of balloon 18 is secured to the junction 11*a* of the frame grid between balloons 13 and 16, but may also be inserted through a grid opening, along side one of balloons 13 or 16, with the air pressure with in balloon 18 holding it in place.

Figure 4:
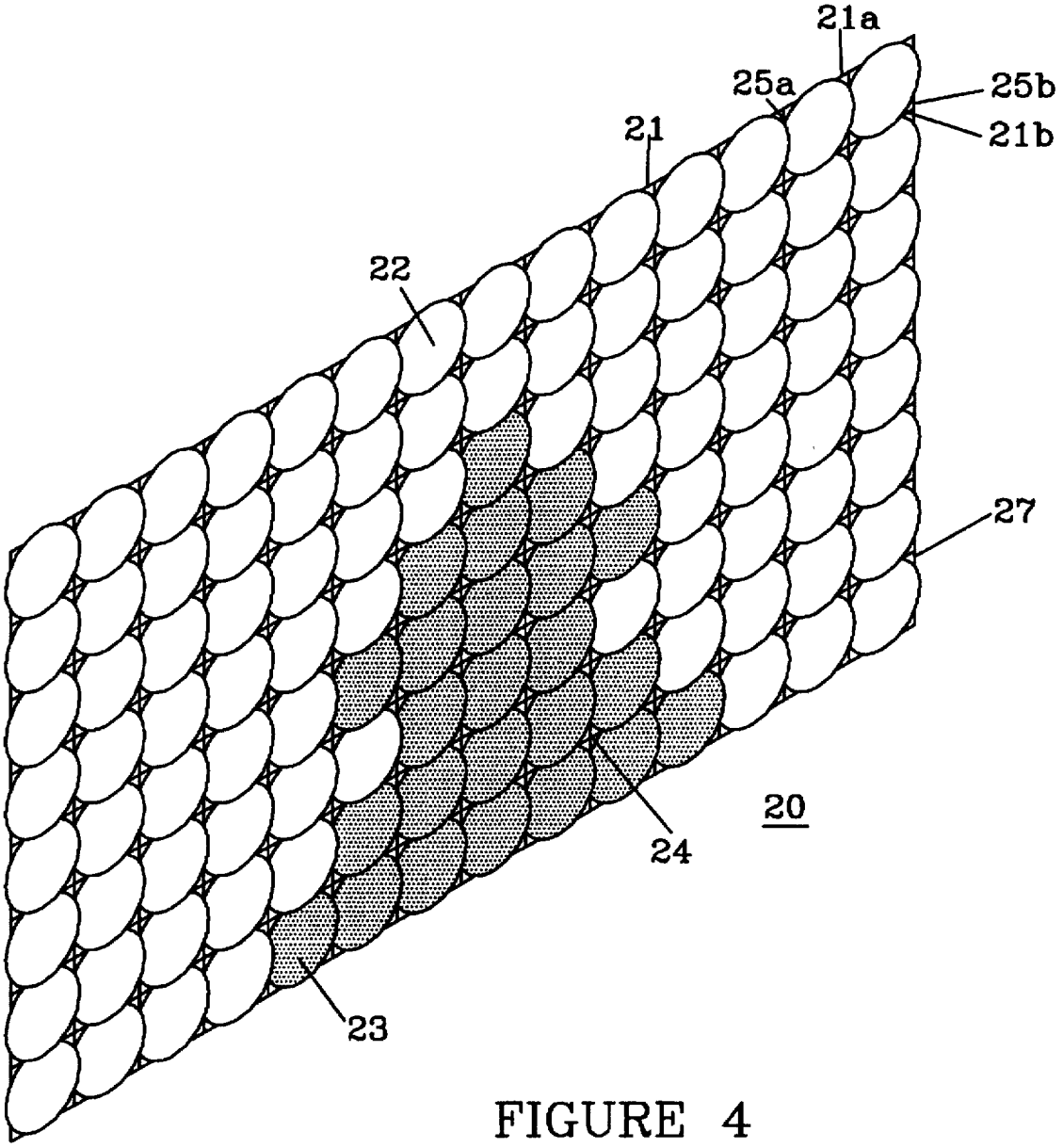
FIG. 4 shows a large array of grid mounted balloons utilizing different color balloons to form a design.

FIG. 4 illustrates a large array 20 made of a grid frame 21. The grid frame has a large number of grid openings 27, each grid opening having two horizontal sides 21*a* and 21*b*, and two vertical sides 25*a* and 25*b*. Adjacent grid openings are joined along common horizontal and vertical sides. The grids have grid element intersection points at 24.

In the display of FIG. 4, a plurality of, for example green balloons 23 are inserted through selected grid openings to form a Christmas tree. Other non-green balloons are placed in the other grid openings not occupied by the green balloons. With the green and non-green balloon inserted in the grid openings and held in place by the air within the balloons, a display representative of a Christmas tree is formed. Any other animate or inanimate objects may be displayed by placing balloons of different colors in the grid openings to outline the desired object.

The design may be varied by changing grid format. For example, a design of large balloons can be out lined by a smaller grid having smaller mounted balloons. Another example is to place large round balloons in a design and to outline the design with smaller or larger balloons.

Figure 5:
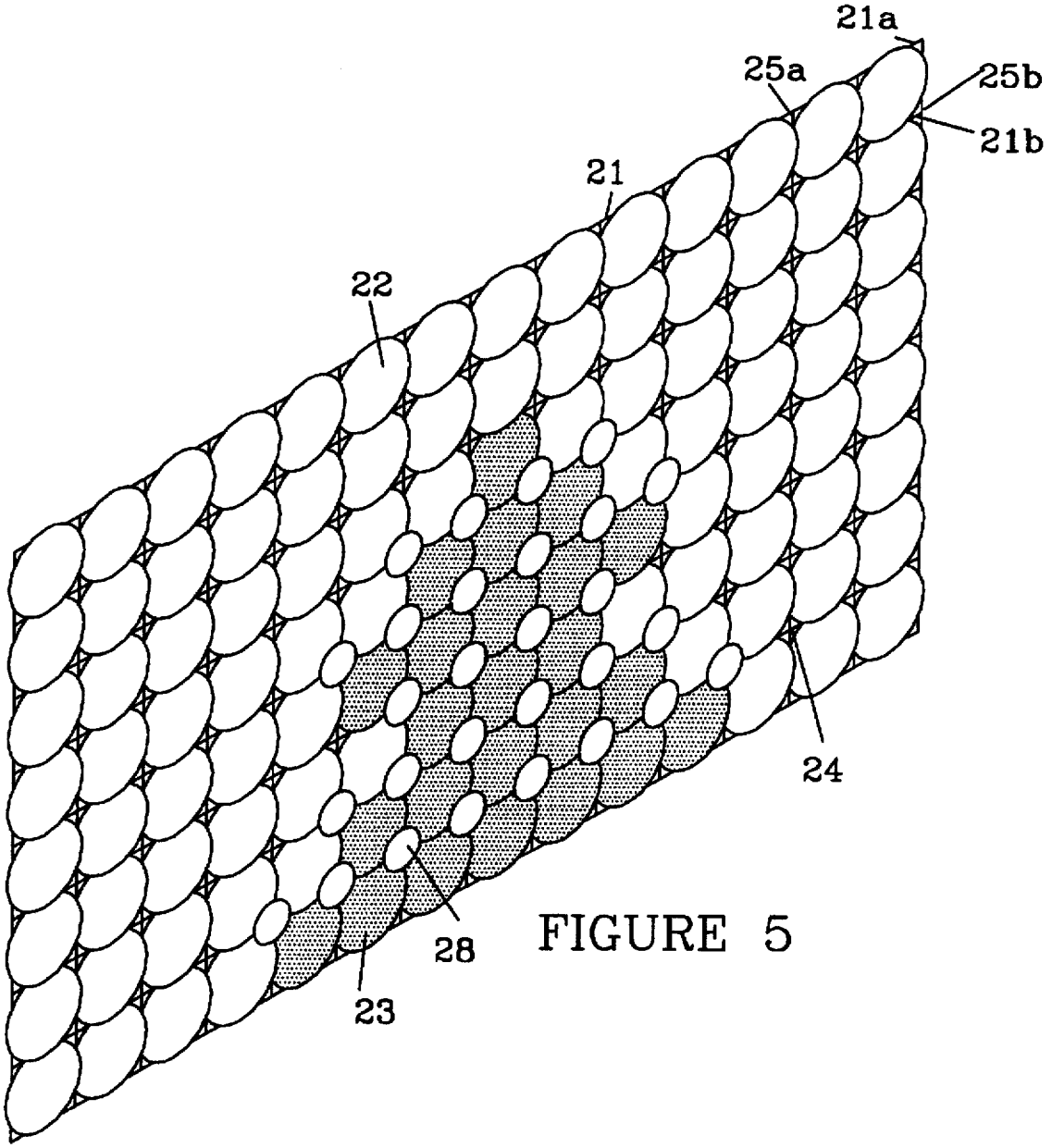
FIG. 5 is a large array of grid mounted balloons as in FIG. 4, with the additional of more balloons to further add to the design.

FIG. 5 illustrates the same basic design of a Christmas tree as in FIG. 4 with balloons 28 added at the intersections 24 of the grid openings at locations on the Christmas tree. Balloons 28 maybe, for example, red balloons to represent ornaments or lights on the Christmas tree. Small electric lights may be placed adjacent some of balloons 28 to illuminate them and to give the effect of lights.

Figure 6:
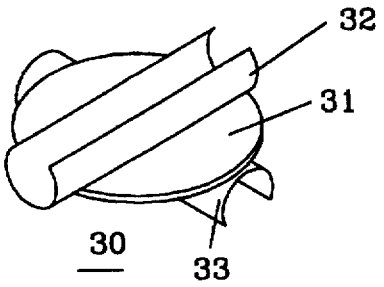
FIG. 6 illustrates a junction device for joining intersecting rods to a form grid.
Figure 7:
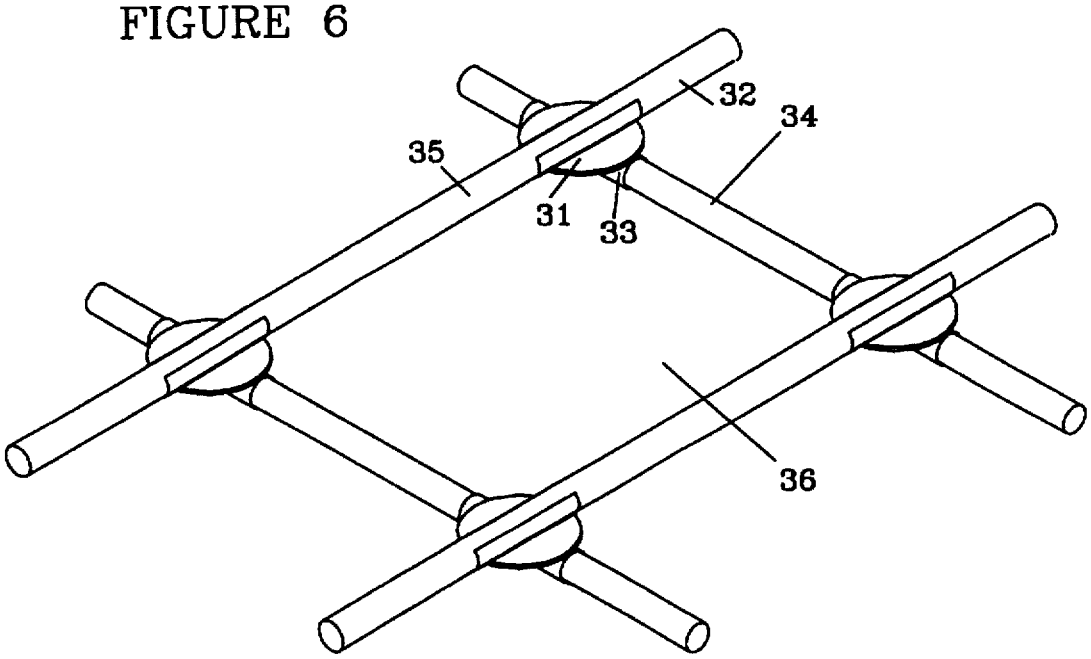
FIG. 7 shows the formation of a grid structure using the junction devices of FIG. 6.

FIG. 6 shows a pivotal joining device to be used in forming grid frames. Plate 31 has first clip 32 on one side and a second clip 33 on another side. Clips 32 and 33 are pivotal mounted on plate 31. Clips 32 and 33 are flexible so that a rod 34, 35 may be inserted and held in place by the spring action of the clip. A plurality of pivotal devices 30 are used to connected a plurality of rods 34, 35 to form a grid structure having a plurality of openings 36 into which balloons are inserted and inflated. The grid frames of FIGS. 1–5 may be constructed utilizing rods and pivotal devices. FIG. 7 shows a grid structure having square or rectangle openings, but triangular or other geometric shaped openings may be assembled using the pivotal devices and rods.

Figure 6A:
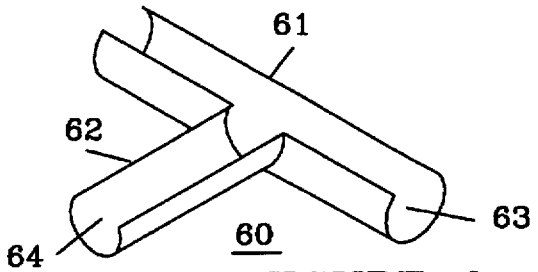
FIG. 6*a* shows a junction device for joining intersecting rods to for a T.

FIG. 6*a* shows a junction device 60 that can be used for the side of a grid frame. Junction device 60 has channel 61 with an opening 63 to hold a rod. Extending at a right angle from channel 61 is channel 62 having an opening 64 to receive a rod. Junction device 60 is useful in forming the outer sides of a grid frame. The openings 63 and 64 in junction device 60 are to the side of a channel, channels 61 and 62 could be tubes with rods inserted in the ends of the channel.

Figure 8:
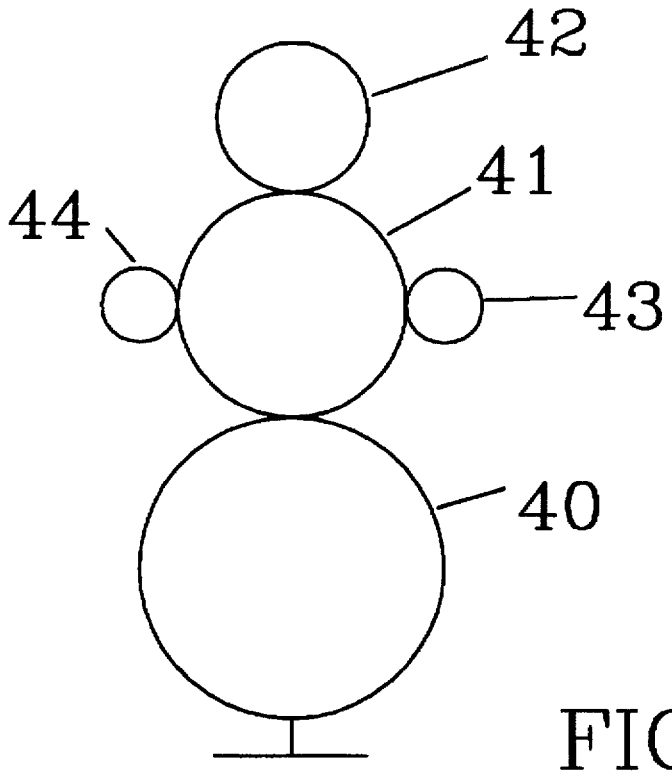
FIG. 8 shows the use of rings to form a grid in a snowman design.

FIG. 8 illustrates the use of joined rings into which balloons may be inserted and inflated to form a snowman. Rings 40–44 are secured together, and then balloons are inserted and inflated in the opening in each ring. Other objects either animated or inanimate may be formed by utilizing similar grid structures using a grid frame with different sized and shaped openings.

Figure 9:
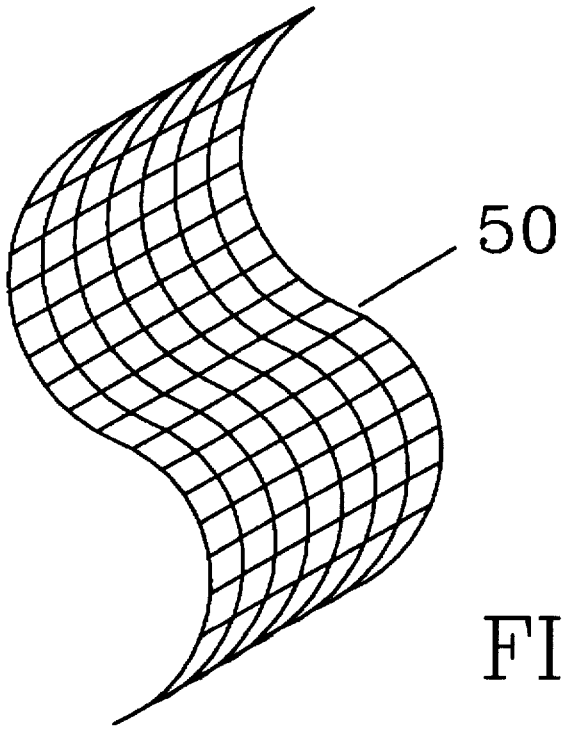
FIG. 9 illustrates the bending of a grid structure to form a three dimensional display.

FIG. 9 shows a flexible grid frame 50 that may be shaped by twisting and curving to provide a decorative grid frame into which balloons are inflated and inserted. A flexible grid structure may be manufactured and sold in rolls so that section may be cut from the roll to form a desired decorative display.

To provide three dimensional effects, several grid frames may be attached to each other some of which may be flat, some rolled and others twisted. Then balloons are inserted in various grid openings to produce the desired display.

What is claimed:

1. A display apparatus displaying balloons comprising:

a) a frame and a plurality of rod-shaped segments;

b) said rod-shaped segments attached to said frame creating a grid array of adjacent openings in said frame which are generally square and of equal size; and c) said adjacent openings sized such that balloons are held in said openings by the pneumatic pressure of the sides of the balloon in contact with the sides of said openings.

2. A method of constructing a display utilizing balloons, comprising the steps of:

a) constructing a grid frame having a plurality of openings therein;

b) inserting balloons into selected openings in the grid frame to produce a design;

c) positioning the balloons such that each balloon is held in an opening by the pneumatic pressure of the air in the inflated balloon pressing against the side of the opening in which the balloon is inserted; and d) distorting the grid frame by twisting and bending to shape the display.

3. A display apparatus displaying balloons, comprising:

a) a grid array including a frame and a plurality of adjacent openings in said frame;

b) said adjacent openings in said frame meet at an intersection; and c) said adjacent openings are sized such that the balloons are held in said openings by the pneumatic pressure of the sides of the balloons in contact with the sides of said grid openings, balloons being secured to selected intersections between said adjacent openings.

4. A method of constructing a display utilizing balloons, comprising the steps of:

a) constructing a grid frame having a plurality of openings therein;

b) distorting the grid frame by twisting and bending to shape a display;

c) inserting balloons into selected openings in the grid frame to produce the display; and d) positioning the balloons such that each balloon is held in an opening by the pneumatic pressure of the air in the inflated balloon pressing against the side of the opening in which the balloon is inserted.

5. A display apparatus displaying balloons comprising:

a) a frame of a plurality of rod-shaped segments;

b) said rod-shaped segments forming said frame creating a grid array of adjacent geometric openings in said frame; and c) said adjacent geometric openings sized such that balloons are held in said openings by the pneumatic pressure of the sides of the balloon in contact with the sides of said openings.

* * * * *